US011629564B1

(12) United States Patent
Harris et al.

(10) Patent No.: US 11,629,564 B1
(45) Date of Patent: Apr. 18, 2023

(54) RETRIEVABLE SEAL GUIDE

(71) Applicants: Robert Harris, Anchorage, AK (US); Carl Diller, Anchorage, AK (US); Candice English, Anchorage, AK (US); John Milne, Anchorage, AK (US)

(72) Inventors: Robert Harris, Anchorage, AK (US); Carl Diller, Anchorage, AK (US); Candice English, Anchorage, AK (US); John Milne, Anchorage, AK (US)

( * ) Notice: Subject to any disclaimer, the term of this patent is extended or adjusted under 35 U.S.C. 154(b) by 144 days.

(21) Appl. No.: 16/868,935

(22) Filed: May 7, 2020

(51) Int. Cl.
*E21B 23/00* (2006.01)

(52) U.S. Cl.
CPC ..... *E21B 23/00* (2013.01)

(58) Field of Classification Search
CPC ..... E21B 23/00
See application file for complete search history.

(56) References Cited

U.S. PATENT DOCUMENTS 5,518,072 A * 5/1996 McTernaghan ..... E21B 23/02 166/115
6,382,324 B1 * 5/2002 Anyan ..... E21B 17/06 166/115

* cited by examiner

*Primary Examiner* — George S Gray
(74) *Attorney, Agent, or Firm* — Michael J. Tavella

(57) ABSTRACT

A retrievable seal guide (RSG) for installing a seal stem in a polished bore receptacle. The RSG has an outer grapple. Inside the grapple is a mandrel. At the end of the RSG is a bullet nose guide. The mandrel is spring loaded with a spring placed under the grapple Near the rear end of the guide is a plug with an o-ring. Note that the bullet nose has an opening formed in it. A channel is also formed down the length of the device. Note too that for tight formations of non-perforated liners the plug can be replaced with a stainless-steel ball that acts as a check valve. As the RSG is pulled out, the guide is pulled back, which compresses the spring forcing the mandrel back until a cam clears the collapsible fingers on the grapple, which allows the RSG to be withdrawn.

12 Claims, 10 Drawing Sheets

RETRIEVABLE SEAL GUIDE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to seal guides and particularly to retrievable seal guides.

2. Description of the Prior Art

In modern oil well construction wells are often built with an outer casing and an inner liner. A polished bore receptacle (PSR) is normally installed at the top of the liner. Cement is then poured between the liner and the casing to lock the liner in place as well as sealing the space. A simplified example of a casing, liner and PBR is shown in FIG. 1, as prior art. The casing 100 is shown with a liner 101 and a PBR 102. The cement 103 is also shown. If the cement fails, a seal, such as positive test seal assembly (PTSA), is typically installed in the PBR. This provides a seal for the liner to prevent leaks. Current practice is to insert the PTSA using a mule shoe. Such a mule shoe 104 is shown in FIG. 2 as prior art, which is found in U.S. Pat. No. 4,094,360. The mule shoe is permanent installation. The shoe is not retrievable. Because of the blunt tip 105 on the mule shoe, when setting seal stems, the front edge of seal stem often goes behind the PBR, wedges into place, and does not seat. When that happens, the seal stem and mule shoe must be pulled back up and then reinserted again. Obviously, this causes delays and extra cost.

BRIEF DESCRIPTION OF THE INVENTION

The instant invention overcomes the difficulties described above. It is a fully retrievable seal guide (RSG) that has a cone shaped tip and a unique collapsing ring that enables the guide to be removed from the well. The cone-shaped tip prevents the PTSA from sticking on the PBR every time. Once the PTSA (also called a seal stem) is installed in the PBR, the RSG is pulled up through the PTSA and out of the well. The RSG aligns with the PBR ensuring that the seal stem is positioned properly every time.

The entire assembly is installed using a liner top packer. The PTSA remains in place and the RSG is pulled up through the PTSA using a setting tool.

The RSG consists of an outer housing called a grapple. Inside the grapple is a mandrel. At the end of the RSG is a section called the guide, which has a bullet nose. The mandrel is spring loaded with a spring placed under the grapple. When the unit is retrieved, a setting tool pulls the mandrel back until a cam clears the collapsible fingers on the grapple, which allows the RSG to be withdrawn through the PTSA.

In most cases, with perforated liners, the guide of the RSG can push the fluid in the liner down and out through the perforations. Near the rear end of the guide is a plug with an O-ring that prevents fluid from backing up through the RSG.

For tight formations or non-perforated liners, the plug is replaced with a stainless steel ball that acts as a check valve. This allows fluid to flow while the PTSA is being set.

DETAILED DESCRIPTION OF THE INVENTION

Figure 1:
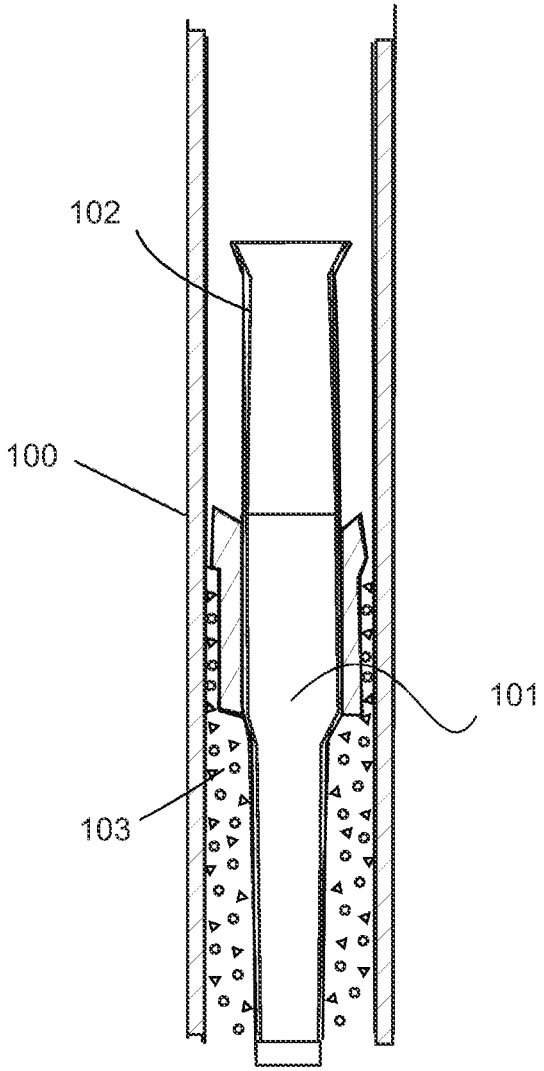
FIG. 1 Prior Art
FIG. 1 is a detail view of a well casing having a liner and a polished bore receptacle as prior art.
Figure 2:
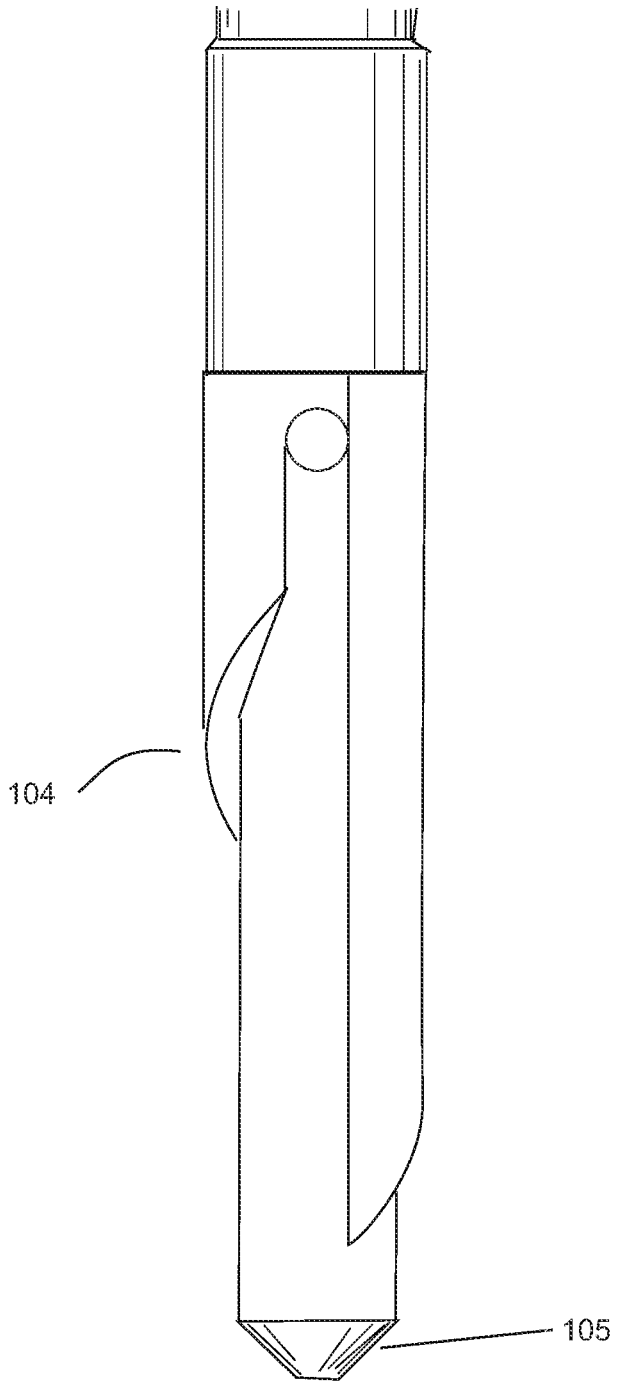
FIG. 2 Prior Art
FIG. 2 is an side view of mule shoe as prior art.
Figure 3:
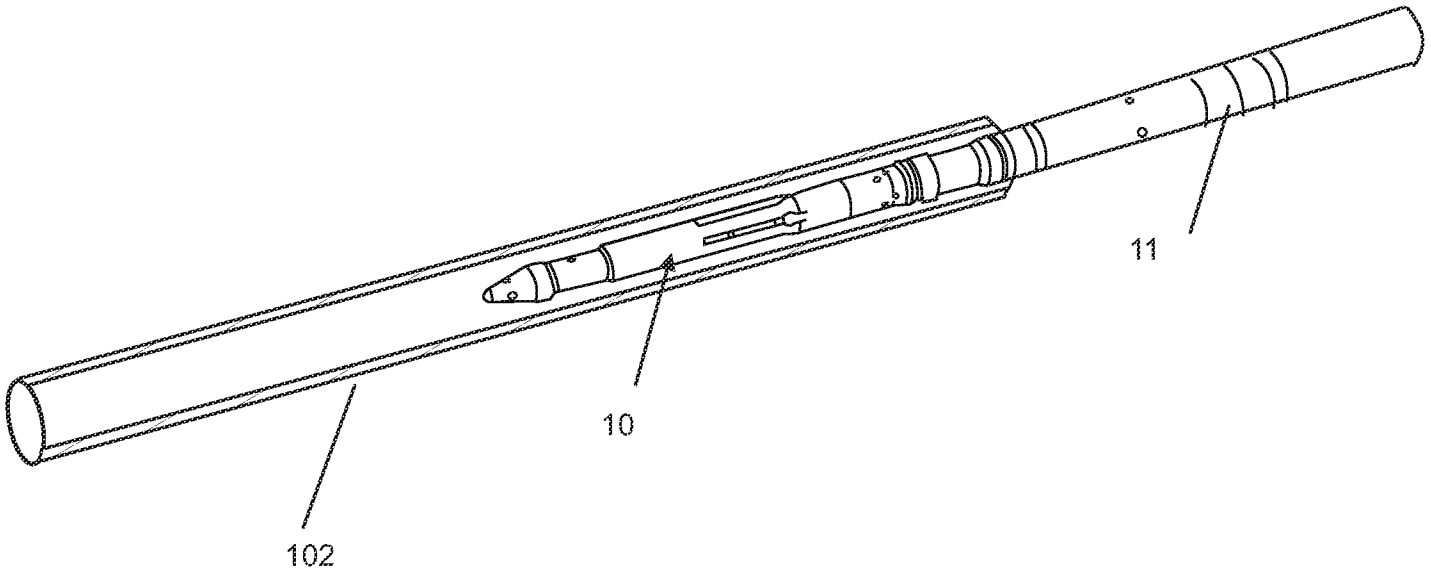
FIG. 3 is a detail view of the RSG and seal stem shown in a run in position.
Figure 3A:
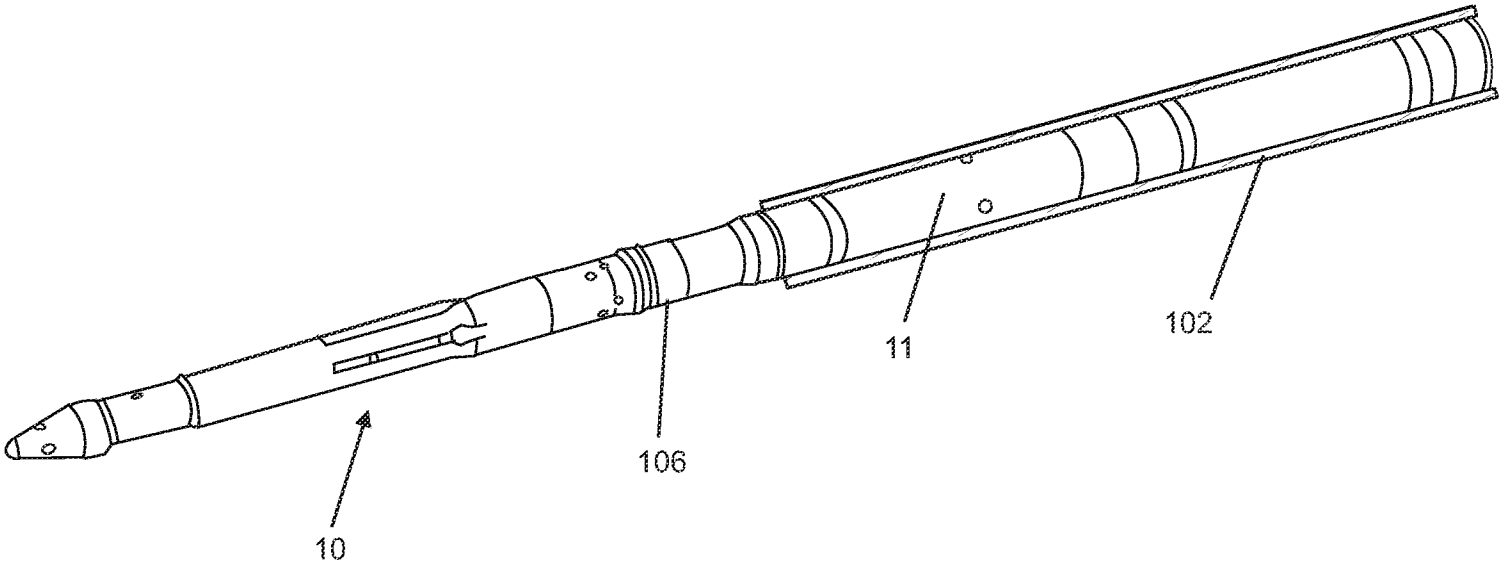
FIG. 3*a* is a detail view of the RSG and seal stem showing the seal stem positioned at the bottom of the PBR.
Figure 4:
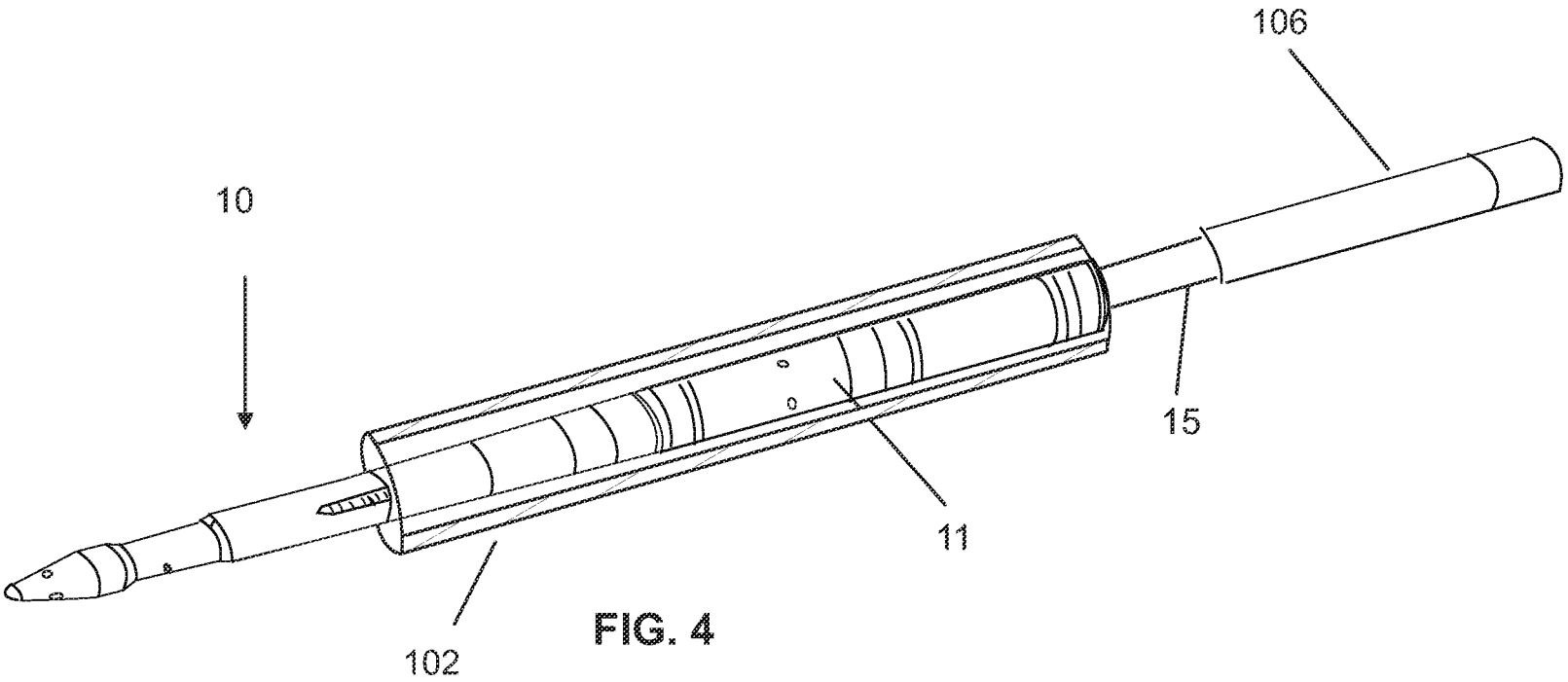
FIG. 4 is a detail view of the RSG being retrieved.
Figure 5:
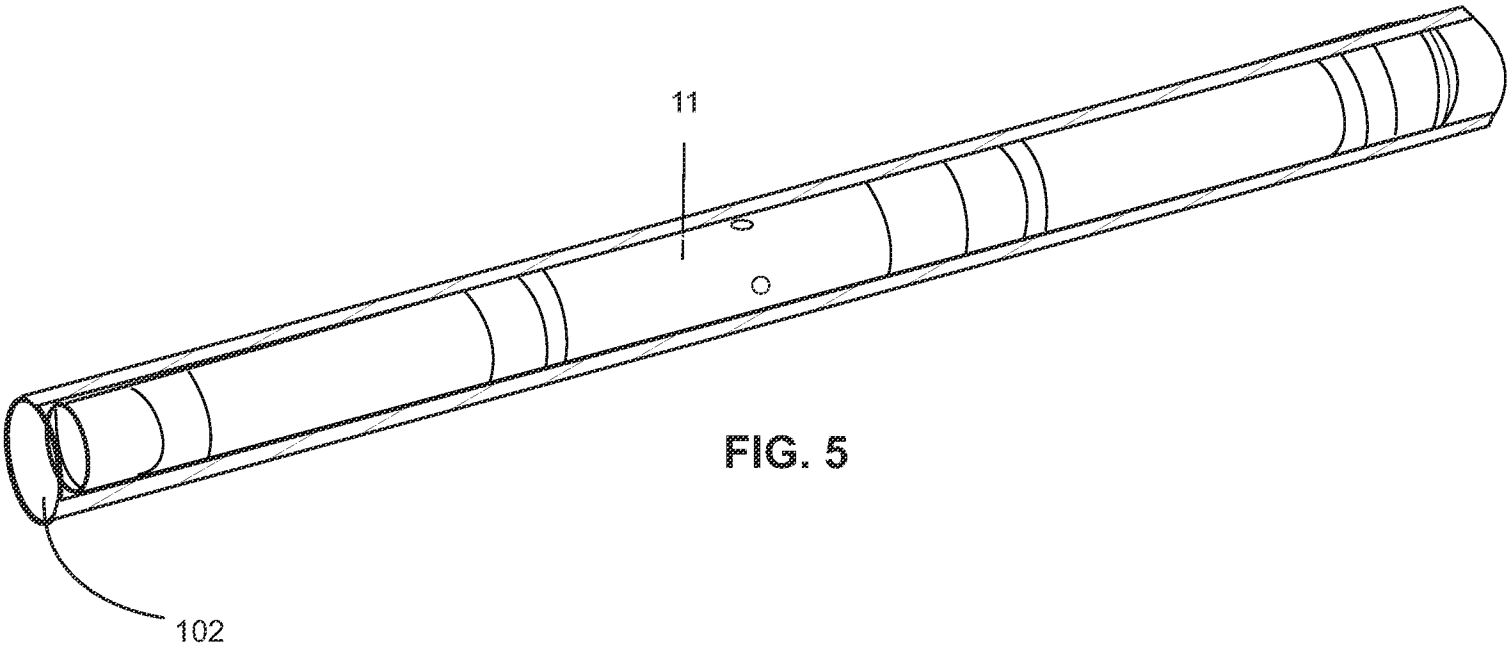
FIG. 5 is a detail view of the seal stem that is left in the hole.

Referring now to the figures and particularly FIGS. 3, 3*a*, 4 and 5, FIG. 3 is a detail view of the RSG and seal stem, shown in a run-in position. Here, the RSG 10 is shown passing through a PBR 102 with a seal stem 11 attached. The RSG 10 enters the liner until the seal stem 11 reaches the bottom of the PBR 102, as shown in FIG. 3*a*. FIG. 4 is a detail view of the RSG being retrieved. In this figure, the RSG 10 is shown being removed from the well. The PBR 102 is shown as before. The seal stem 11 is shown remaining in the PBR while the guide is removed. Note the setting tool 106 is shown in this drawing. Details of the exact removal process are discussed below. FIG. 5 is a detail view of the seal stem that is left in the hole. Here, the PBR 102 is shown with the seal stem 11 remaining in place. The rest of the RSG and setting tools are gone.

Figure 6:
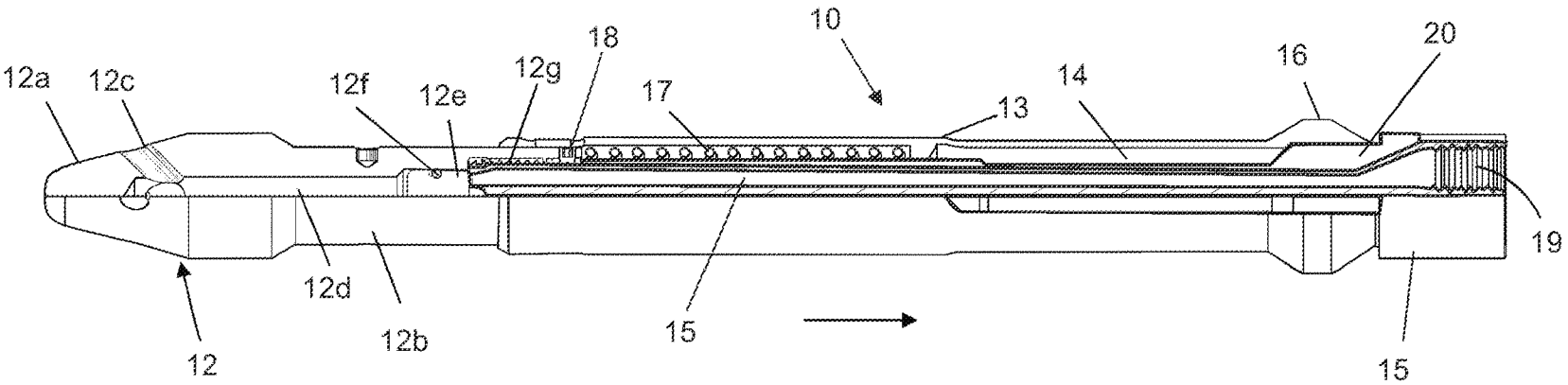
FIG. 6 is a partial cut-away view of the preferred embodiment of the RSG showing the mandrel in a partial cutaway view.

FIG. 6 is a side, partially cutaway view of the RSG 10. As shown, the main external components of the RSG 10 are as follows. First, is the guide 12, at the end of the tool. The guide 12 fits into a grapple 13 that has a slot 14 formed in it, as shown. A mandrel 15, here shown partially cutaway to show the open interior of the mandrel, fits inside the grapple 13. The mandrel is internally connected to the guide 12 and is spring loaded so that then the mandrel 15 is pulled upwards, the guide 12 is pulled up into the grapple. As discussed below, a cam system causes a set of collapsible fingers 16 formed on the grapple to collapse inward, allowing the grapple to fit within the seal stem. Normally the fingers prevent the seal stem 11 from falling down off the end of the RSG. When the RSG is retrieved, these fingers collapse, as discussed below. Once the fingers are collapsed, the RSG can be pulled through the seal stem and out of the well. Each of the components discussed above are discussed in greater detail below.

Figure 7:
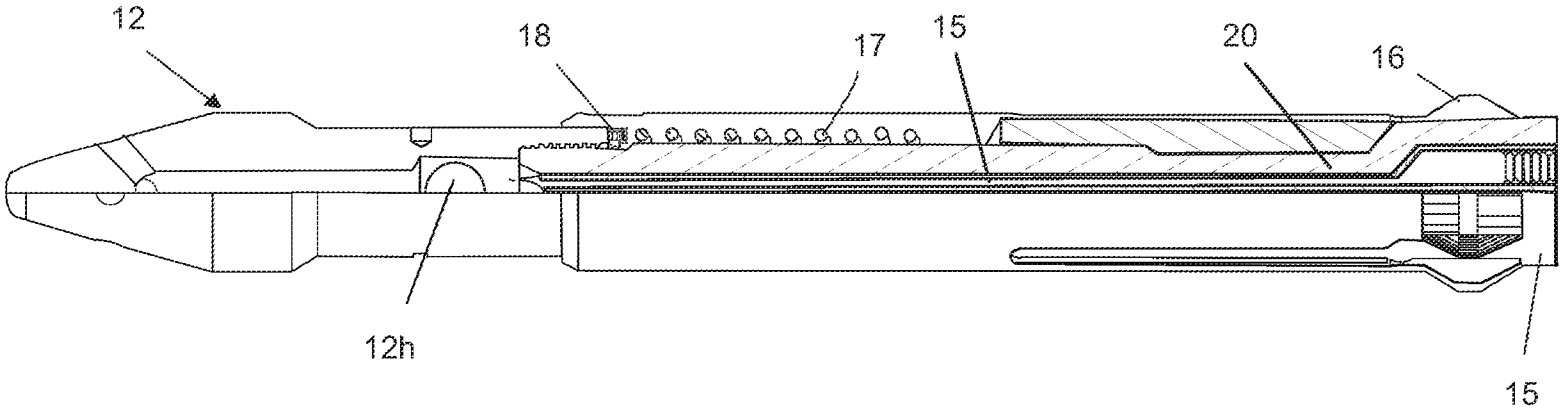
FIG. 7 is a cross-sectional view of a second embodiment of the RSG.

FIG. 7 is a cross-sectional view of a second embodiment of the RSG 10. In this view, the mandrel 15 is shown attached to the guide 12. As discussed above, the guide 12 has a tapered head 12*a*, and a rear body 12*b*. Near the end of the guide is an opening 12*c*, through which fluids can flow. The opening 12*c* is connected to a channel 12*d*. At the end of the channel 12*d* is a plug 12*e*, which acts as a solid seat. The plug 12*e* has an O-ring 12*f*. The plug 12*e* is used to prevent fluid from entering the guide. Because, in most cases, the liner is perforated, fluid in the liner can be pushed down and out through the perforations, preventing excess pressure and allowing the seal stem to seat.

The grapple 13 fits around both the mandrel 15 and the guide 12. A spring 17 fits between the mandrel 15 and the grapple 13*b* as shown. A set screw 18 locks the mandrel 15 to the guide 12 to prevent the threads 12*g*, which secure the guide 12 to the mandrel 13, from rotating.

At the rear end of the mandrel 15 are threads 19 that allow the mandrel (and thus the RSG) to be attached to a setting tool (see e. g., FIG. 4). When the setting tool pulls on the mandrel 15, the mandrel and guide move within the grapple 13 in the direction of the arrow shown. This causes the spring 17 to compress. It also causes the cam 20 to move back (see inset FIG. 6*a*). As shown, once the cam 20 passes the fingers 16, a gap is formed that allows the fingers to bend inwardly to contact the mandrel, which allows the fingers to fit inside the seal stem. See FIG. 6*a*. Normally the fingers prevent the seal stem 11 from falling down off the end of the RSG. When the RSG is retrieved, these fingers collapse, as discussed above. Once the fingers are collapsed, the RSG can be pulled through the seal stem and out of the well.

Figure 6A:
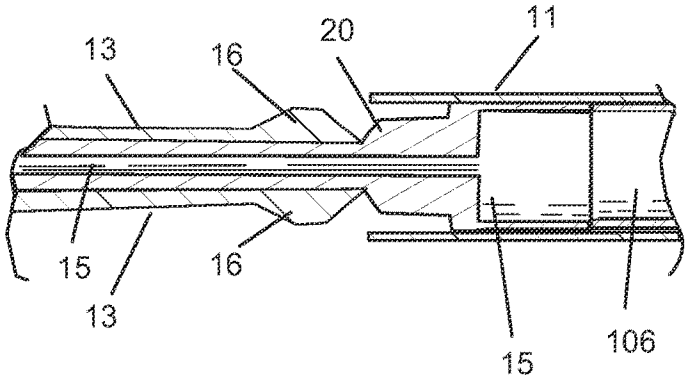
FIG. 6*a* is a side detail partial cutaway view showing the cams and mandrel partially withdrawn and the collapsible fingers collapsed on the RSG.

FIG. 6*a* shows a portion of the mandrel 15 and grapple 13 showing the collapsible fingers 16 and the seal stem 11. Once the cam 20 is pulled back, the fingers 16 have room to collapse so that the RSG can pass into the seal stem 11 and then be pulled from the well.

Figure 8:
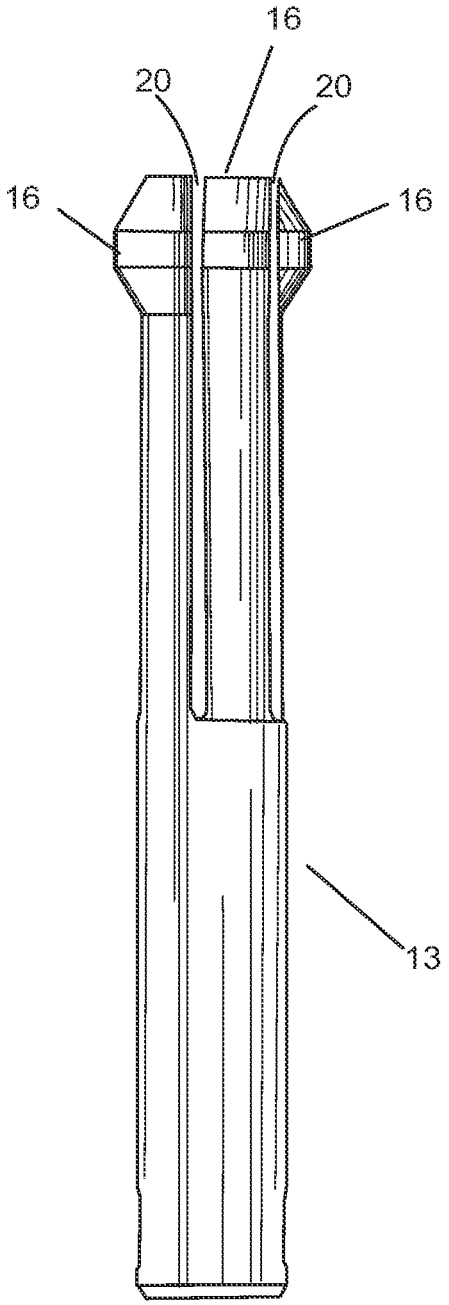
FIG. 8 is a detail view of the grapple in isolation.

FIG. 8 is a detail view of the grapple 13 in isolation.

Figure 9:
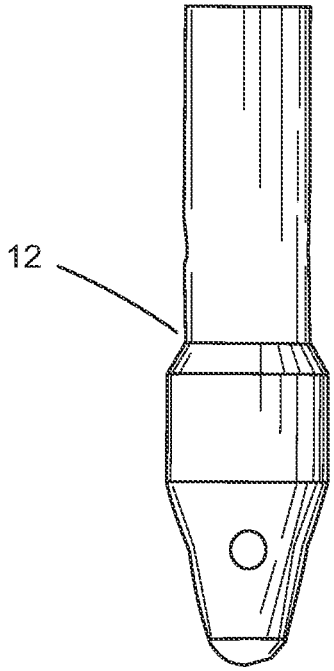
FIG. 9 is a detail of the guide in isolation.

FIG. 9 is a detail of the guide 12 in isolation.

Figure 10:
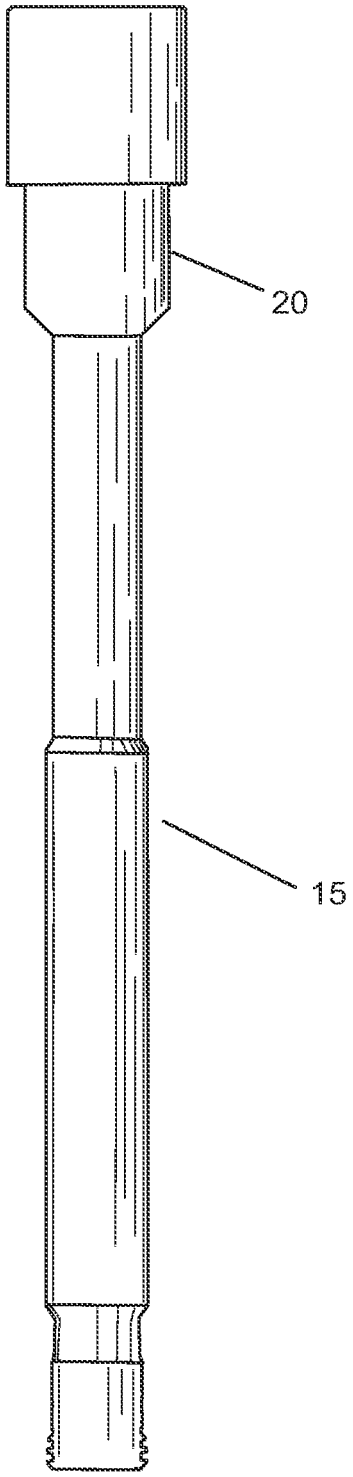
FIG. 10 is a detail of the mandrel in isolation.

FIG. 10 is a detail of the mandrel 13 in isolation.

FIG. 7 is a cross-sectional view of a second embodiment of the RSG. In this view, the RSG is virtually identical to the previous embodiment. However, in this embodiment, the block 12*e* is replaced by a steel ball 12*h*. The ball is another one of the means of sealing the channel and is in operable communication with the channel. This ball is used as check valve in tight formations or non-perforated liners. The fluid in the liner pushing against the ball, floats the ball out of its seat allowing the pressure to drop and allowing seal stem to seat.

The RSG allows for easy insertion of seal stems with complete retraction of the RSG. These is no problem setting the seal stem in the PSR. This saves time and money.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

What is claimed is:

1. A retrievable seal guide for inserting a seal stem into a polished bore receptacle, using a setting tool, comprising:

a) a guide, having a front and a back, having a tapered head at the front, and a rear body at the back;

b) a mandrel, having an elongated body having a front and a back, the front of said mandrel being connected to the rear body of said guide, the back of said mandrel having a threaded cylinder, and also having a cam formed thereon;

c) a grapple, having a front portion and a rear portion that fits around both the mandrel and the rear body of the guide, said grapple also having a slot formed in the back portion thereof, and a set of collapsible fingers formed about the rear portion thereof, said set of collapsible fingers being in operable communication with the cam on said mandrel;

d) wherein, said guide, mandrel and grapple are assembled into a unit and placed into said seal stem, having a top and a bottom, such that the guide, mandrel and grapple pass through the seal stem until the grapple fingers extend and are held by the cams on said mandrel, thereby preventing said seal stem to slide downwardly on said retrievable seal guide until said seal stem is positioned in said polished bore receptacle, and further wherein said setting tool is attached to said threaded cylinder at the back of said mandrel, for insertion of said unit and said seal stem into said polished bore receptacle;

e) and further wherein after said seal stem is positioned in said polished bore receptacle the setting tool is then pulled upwards, causing said mandrel and said guide to be pulled upwards simultaneously, said upward movement causing said cam on said mandrel to be moved upwardly until said cam is clear of said collapsible fingers on said grapple, causing said collapsible fingers to collapse inwardly, allowing said grapple to pass through said seal stem with said mandrel and said guide until said grapple is completely removed from said seal stem.

2. The retrievable seal guide of claim 1 further comprising:

a spring positioned in said grapple such that said spring is in operable communication with the rear body of said guide.

3. The retrievable seal guide of claim 2 having a first position, wherein such spring is expanded, for insertion and a second position, wherein such spring is compressed, for retrieval.

4. The retrievable seal guide of claim 3 wherein when said spring is compressed, said cam on said mandrel is positioned off of said collapsible fingers such that said collapsible fingers collapse into said grapple.

5. The retrievable seal guide of claim 2 wherein the guide further includes:

a) an opening connected to a channel formed in said guide; and b) a means of sealing said channel in operable communication with said channel.

6. The retrievable seal guide of claim 5 wherein the means of sealing said channel in operable communication with said channel comprises a plug that has an O-ring installed around said plug.

7. The retrievable seal guide of claim 5 wherein the means of sealing said channel in operable communication with said channel comprises a ball.

8. The retrievable seal guide of claim 2 further comprising a set screw that locks the mandrel to the guide.

9. The retrievable seal guide of claim 1 wherein the guide further includes:

a) an opening connected to a channel formed in said guide; and b) a means of sealing said channel in operable communication with said channel.

10. The retrievable seal guide of claim 9 wherein the means of sealing said channel in operable communication with said channel comprises a plug that has an O-ring installed around said plug.

11. The retrievable seal guide of claim 9 wherein the means of sealing said channel in operable communication with said channel comprises a ball.

12. The retrievable seal guide of claim 1 further comprising a set screw that locks the mandrel to the guide.

* * * * *